United States Patent [19]

McDermott

[11] Patent Number: 4,648,324

[45] Date of Patent: Mar. 10, 1987

[54] PROJECTILE WITH ENHANCED TARGET PENETRATING POWER

[75] Inventor: Brian K. McDermott, Marion, Ill.

[73] Assignee: Olin Corporation, Stamford, Conn.

[21] Appl. No.: 782,645

[22] Filed: Oct. 1, 1985

[51] Int. Cl.[4] ..... F42B 11/06

[52] U.S. Cl. ..... 102/518; 102/364

[58] Field of Search ..... 102/473, 474, 364, 501, 102/517–519

[56] References Cited

U.S. PATENT DOCUMENTS

| | | | |
|---|---|---|---|
| 1,150,667 | 8/1915 | Dunwoody | 102/518 |
| 3,302,570 | 2/1967 | Marquardt | 102/364 |
| 3,677,181 | 7/1972 | Giljarhus et al. | 102/364 |
| 3,992,996 | 11/1976 | Strandli | 102/364 |
| 4,353,302 | 10/1982 | Strandli et al. | 102/364 |

FOREIGN PATENT DOCUMENTS

| | | | |
|---|---|---|---|
| 1605020 | 12/1981 | United Kingdom | 102/364 |

*Primary Examiner*—Harold J. Tudor

*Attorney, Agent, or Firm*—Bruce E. Burdick

[57] ABSTRACT

A projectile with enhanced power for penetrating a target includes an elongated thick-walled casing having a main body with a cavity and a nose with a bore. The nose is interfitted with the main body such that its bore merges with the cavity. An elongated rod-like heavy penetrator extends longitudinally through the main body cavity and into the nose bore. An incendiary charge is disposed in the nose bore, whereas an explosive charge is disposed in the main body cavity. An annular ring is anchored to the main body at the location where the nose bore merges with the main body cavity. The ring has a central opening through which the penetrator is received and aligned for forward penetrating travel upon impact of the nose with the target. The ring separates the nose bore and the main body cavity, retaining the incendiary charge in the nose bore. Finally, the ring contains spaced axial apertures which provide communication of the nose bore with the main body cavity so as to allow ignition of the incendiary charge to travel through the ring and detonate the explosive charge after impact of the nose with the target. Preferably, the penetrator is coupled to the ring for acceleration to a higher velocity upon detonation of the charge.

16 Claims, 10 Drawing Figures

PROJECTILE WITH ENHANCED TARGET PENETRATING POWER

BACKGROUND OF THE INVENTION

1. Field of the Invention

The present invention generally relates to ordnance for destroying a target and, more particularly, is concerned with a projectile incorporating a unique penetrator capable of penetrating a successively more difficult multiple plate array in a target.

2. Description of the Prior Art

Armor-piercing projectiles having an outer shell and containing small amounts of igniting, incendiary and/or explosive charges are conventional weapons of warfare used in both offensive and defensive modes. Such projectiles are most effective when their destructive force is unleased after they impact and hopefully penetrate the target. Thus, it is common practice to incorporate some means for delaying ignition of the incendiary and/or explosive charges carried by the projectile until after impact. Representative of the prior art employing this practice are the projectiles disclosed in U.S. Patents to Giljarhus et al (U.S. Pat. No. 3,677,181), Strandli (U.S. Pat. Nos. 3,980,020; 3,980,021; and 3,922,996).

In addition, there was a Frankford Arsenal APIE (armor-piercing-incendiary-explosive) test round described at page 129 of Hackler, Woodin and Scranton, History of U.S. Military Small Arms Ammunition, Volume II, 1940–1945 (1978). This was one of literally dozens of test round labeled FAT1 which led to the M8 incendiary round. Little is now known about this round, except that it was one of many FAT1 rounds developed in World War II, but this particular versions was never produced in anything more than experimental quantities because another design was selected for the M8 round.

A common countermeasure used by designers of warfare array of multiple plates for the purpose of making it difficult, if not impossible, to penetrate and destroy the equipment. One technique adopted to bolster the penetrating power of the projectile is to employ primary and secondary penetration elements in the weapon. Representative of the prior art employing this technique are the projectiles disclosed in U.S. Patents to Weiss (U.S. Pat. No. 2,564,870) and Strandli et al (U.S. Pat. No. 4,353,302). In particular, the projectile of Weiss includes two shell elements, each containing an explosive charge and being disposed one behind the other in tandem-like fashion. The rear shell element is given an armour piercing power higher than that of the front shell element and the front element is designed to pierce only a relatively thin sheet and then explode behind it. Next, the rear element is designed to pierce an armour plate located beyond the thin sheet and explode behind the thicker plate. Thus, the Weiss projectile is intended to pass through walls of increasing resistance, defeating this particular countermeasure designed to protect the equipment.

While the aforementioned basic technique embodied by the Weiss projectile has merit, it is anticipated that the particular construction disclosed in the patent will achieve its objective, if at all, only under very limited conditions. First of all, the rear shell element interfits with the front shell element in such a way that much of the impact force of the front element against the target will be transmitted to the rear shell causing dissipation of much of its energy and penetrating power. Second, the explosion of the explosive in the front shell apparently acts rearwardly against the front of the rear shell, tending to slow it further, Therefore, the first wall of the target must be very fragile compared to and be only a short distance from the second armour plate in order for the rear element to still retain sufficient energy to pierce the plate and to pierce the second plate before the rear shell detonates. Thirdly, the Weiss construction fails to ensure that the charge contained in the rear shell element will always be used to its full capability for its effectiveness is totally dependent upon the rear element successfully piercing the armour plate. Should the rear element fail to penetrate the plate, the explosion of the charge will only destroy the rear element in front of the plate and presumably fail to destroy the equipment protected by the plate. Fourth, the Weiss projectile uses a rapid fire mechanical fuze which makes the delay too short for many applications. Fifth, the Weiss projectile has a fat rear shell which in order to penetrate must make a big hole which takes a lot of Kinetic energy. Sixth, Weiss teaches a rear shell which has a shoulder to support the front shell and this shoulder apparently impinges flatly against the target, thus using up extra energy.

Consequently, in view of the above-described shortcomings in the design of the Weiss projectile, and the unrealized nature of the FAT1 APIE round, a need still remains to come up with an improved projectile design which will more completely realize the potential of the technique underlying the Weiss design.

SUMMARY OF THE INVENTION

The present invention provides an improved projectile design capable of satisfying the aformentioned needs. The improved projectile has a heavy hardened-walled body and contains a long rod-like heavy penetrator with a high length to diameter ratio. Two embodiments of the projectile containing the long, small-diameter heavy penetrator are disclosed. In either embodiment, the penetrating power of the improved projectile is enhanced.

In the preferred embodiment, the penetrator is coupled to an apertured ring anchored within the projectile. The apertures in the ring allow ignition to occur upstream of the ring upon initial impact with the target and then travel rearward past the ring to effect detonation in the projectile downstream of the ring.

The ring itself then serves to accelerate the penetrator to a higher velocity. The acceleration of the ring and rod results from the extremely high pressure from the deflagration and detonation of the incendiary and explosive acting on the piston pushing it out the short cylindrical section of the mouth of the projectile. This unique projectile can penetrate into the forebody of an incoming missile—such as a cruise missile attacking a Naval vessel—and after penetrating the skin of the missile and traveling approximately 8 inches to 24 inches inside the missile, the projectile detonates.

The detonation blast and overpressure and projectile body fragmentation damages the radar guidance package and other equipment in the forebody of the missile. The damage frequently should disable the missile such that it does not strike the intended target. However, in the event that the damaged missile continues a ballistic trajectory toward the ship, the projectile has a second feature which can destory the missile war head by causing it to detonate before striking the ship. This second feature is the long rod penetrator that is launched from the projectile by virtue of the explosive force acting on the piston (ring) which attached to the rod the long rod penetrator is accelerated into the armoured warhead, penetrating the armour and causing the explosive in the warhead to detonate. Therefore, the projectile has two ways to defeat the incoming missile—one by the blast, overpressure, and fragmentation of the projectile body inside the forebody of the missile, and the other is by launching the long rod penetrator into the armoured explosive warhead. This concept also allows the projectile to impact a plate array at velocities below the projectile's threshold for shattering on impact and to offset the normal velocity loss through the array by the boost in velocity received by the penetrator from the detonation occurring after initial impact. This initial partial penetration, detonation shell fragmentation and accelerated long-rod penetration sequence can be repeated with similar following projectiles until the target is fully penetrated and defeated. See FIG. 9. In this scenario, (defending against missiles) the most important feature initially is the partial penetration and delayed detonation with the associated fragments and over-pressure. The combination of the two should rip off the front section of the missile due to the confined volume and structural design which cannot contain the large fragments or massive quantity of gas produced at detonation. Then the following rounds can launch their penetrators at a less and less difficult target with each successive shot.

Accordingly, the present invention is directed to a projectile with enhanced power for penetrating a target, comprising: (a) a elongated casing having a main body with a hollow cavity defined therein and a nose with a hollow bore defined therein, the nose being interfitted with the main body and merged at its bore with the cavity of the main body; (b) an elongated rod-like penetrator extending longitudinally within the casing and through the cavity in the main body thereof and into the bore of the nose thereof; (c) a first destructive charge disposed in the nose bore; (d) a second destructive charge displaced in the main body cavity; and (e) means disposed within the casing so as to generally separate the nose bore and the main body cavity and retain the first charge in the nose bore, the means receiving and aligning the penetrator for forward penetrating travel upon impact of the nose with the target and also defining at least one passageway or aperture which provides communication of the nose bore with the main body cavity for allowing travel of ignition of the first charge from the nose bore to the main body cavity and detonation of the second charge in the main body cavity after impact of the nose with the target.

More particularly, the means receiving and aligning the penetrator is an annular support ring disposed within the casing at the location where the nose is interfitted with the main body, the ring being anchored to at least one of the main body and nose of the casing. The ring has a central opening through which the penetrator is received and aligned for forward penetrating travel upon impact of the nose with the target.

The penetrator is coupled to the ring for acceleration to a higher velocity upon detonation of the second charge. In one form, (see FIG. 1), the coupling between the penetrator and the ring is in the form of a head defined on the front of the penetrator which overlies the ring and faces toward the nose bore. In another form (see FIG. 2), the coupling between the penetrator and the ring is in the form of a shoulder defined on the penetrator which overlies the ring and faces toward the nose bore.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
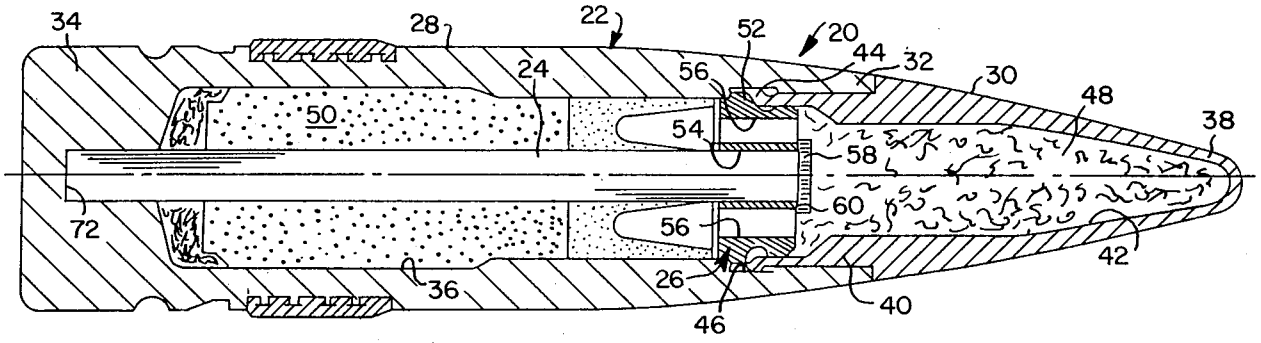
FIG. 1 is a longitudinal sectional view of the preferred embodiment of the improved projectile of the present invention wherein its elongated penetrator is coupled to an apertured ring anchored in the projectile.

Referring now to the drawings, and particularly to FIG. 1, there is shown a projectile with enhanced target penetrating power, generally designated 20 and constituting the preferred embodiment of the present invention. In its basic components, the projectile includes an elongated casing 22, an elongated rod-like penetrator 24 and an annular ring 26 supporting the penetrator 24 in a longitudinal orientation within the casing 22.

The casing 22 of the projectile 20 is made of heavy, hard metal, such as steel, depleted uranium, tungsten alloys, or tungsten and has a generally cylindrical main body 28 and a generally conical nose 30. The main body 28 has opposite leading and trailing ends 32, 34 and a hollow cavity 36 defined therein. The cavity 36 extends between the opposite leading and trailing ends 32, 34 and is closed at the trailing end 34 and open at the leading end 32 of the body 28. The nose 30 has opposite front and rear ends 38, 40 and a hollow bore 42 defined therein. The bore 42 extends between the front and rear ends 39, 40 and is closed at the front end 38 and open at the rear end 40 of the nose 30. Also, the nose 30 is interfitted at its rear end 40 with the leading end 32 of the main body 28 and merged at its bore 42 with the cavity 36 of the main body 28 so as to interconnect and close the rear nose and leading body ends 40, 32. Specifically, the interconnection is made by deformation of a circumferential flange 44 on the rear end 40 of the nose 30 outwardly into a circumferential groove 46 formed internally in the leading end 32 of the main body 28.

The elongated, heavy rod-like penetrator 24 extends longitudinally within the casing 22 and through the cavity 36 in the main body 28 and into the bore 42 of the nose 30. Preferably, the penetrator 24 has a high length to diameter ratio. Further, the bore 42 in the casing nose 30 contains a charge of destructive material, such as an incendiary charge 48, such as, for example, an oxidizer such as potassium perclorate (KCLD-4) with a metal fuel such as aluminum or magnesium whereas in the cavity 36 of the main body 28 is placed another charge of destructive material, such as a gas producing incendiary charge 76 such as a mixture of ammonium nitrate and or barium nitrate along with a powdered metal fuel, such as aluminum or magnesium. Directly following the gas producing charge should be the main explosive 50 which can be RCX, HMX, PETN, TNT or equivalent, which could be followed by a coarse (long burning) incendiary 78 such as zirconium for firestart capabilities.

The annular ring 26 of the projectile 20 which supports the elongated penetrator 24 is disposed within the casing 22 at the location where the rear nose end 40 interfits with the leading main body end 32 and the nose bore 42 merges with the main body cavity 36. Specifically, the annular ring 26 is anchored to the casing main body 28 and prevented from moving rearwardly into cavity 36 by an outwardly-projecting circumferential rim 52 on the ring 26 which fits within the circumferential groove 46 in the main body 28 behind the flange 44 on the nose 30. In such location, the ring 26 generally separates the nose bore 42 and the main body cavity 36 and retains the incendiary charge 48 in the nose bore 42.

Additionally, the ring 26 has a central opening 54 through which the penetrator 24 is tightly received and aligned for facilitating forward penetrating travel of the penetrator upon impact of the nose 30 with a target, as will be described below. Finally, the ring 26 and/or penetrator 24 or body 22 has a plurality of axially extending passageways such as apertures 56 or **56*a* defined therein in a circumferentially and symmetrically spaced arrangement about the penetrator 24 which extends through or past the central ring opening 54. These passageways such as apertures 56 provide communication between the nose bore 42 and the main body cavity 36 through the ring 26 whereby ignition of the incendiary charge 48 in the nose bore 42 can travel rearward through the ring 26 and thereby detonate the explosive charge 50, being contained about the penetrator 24 and behind the ring 26 in the main body cavity 36, after impact of the nose 40** with the target.

Figure 2:
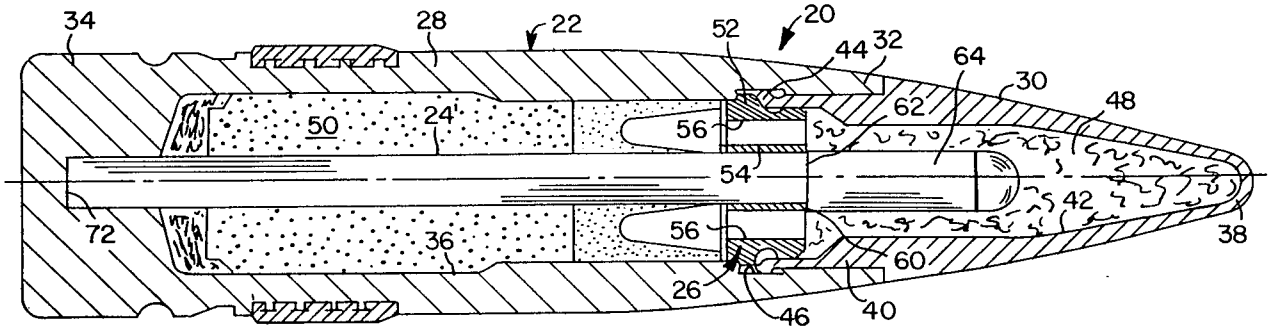
FIG. 2 is another longitudinal sectional view of the preferred embodiment of the improved projectile, but showing its elongated penetrator coupled to the apertured ring in a way slightly modified from that seen in FIG. 1.

Penetrator 24 is coupled to the ring 26 for acceleration to a higher velocity upon detonation of the explosive charge 50. One form of the coupling between the penetrator 24 and the ring 26 is seen in FIG. 1, while a slightly modified form is shown in FIG. 2. In FIG. 1, the coupling is in the form of an enlarged head 58 defined on the penetrator 24 which overlies the portion of the forward surface 60 of the ring 26 surrounding the central ring opening 54 and on the side thereof facing the nose bore 42. In FIG. 2, the coupling takes the form of a shoulder 62 defined by an enlarged head 64 on the penetrator 24' which again overlies the portion of the forward surface 60 of the ring 26 surrounding the central ring opening 54. The enlarged head 64 on the penetrator 24' in FIG. 2 has a much greater length than that of the enlarged head 58 of the penetrator 24 in FIG. 1.

Figure 3:
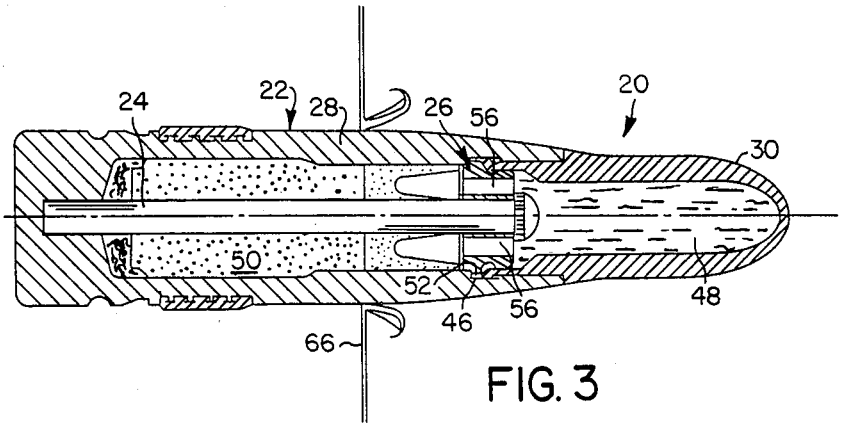
FIGS. 3 through 7 are schematical representations of the projectile of FIG. 1 at sequential stages during penetration of a pair of successive increasingly thicker plates of a target.
Figure 4:
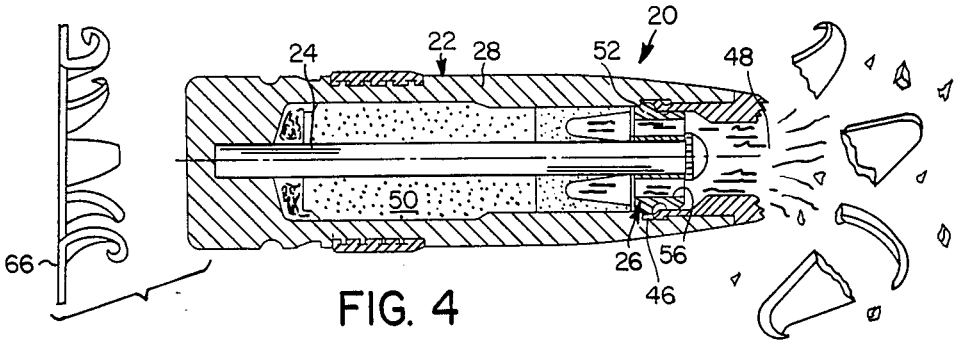
Figure 5:
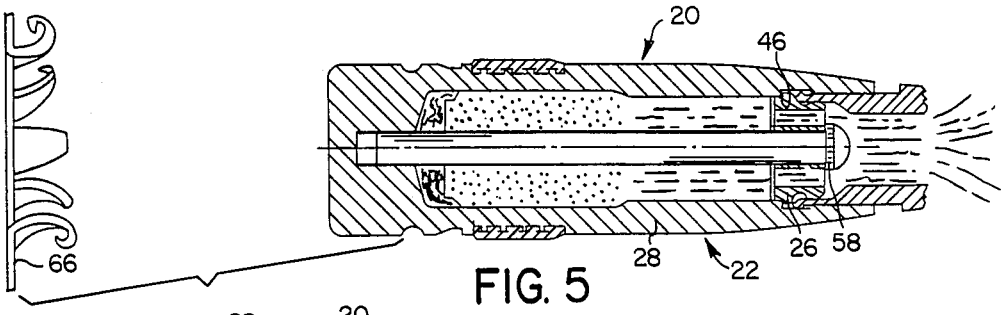
Figure 6:
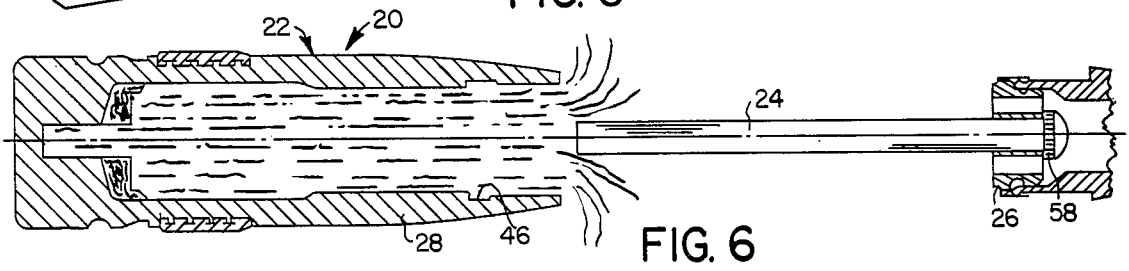
Figure 7:
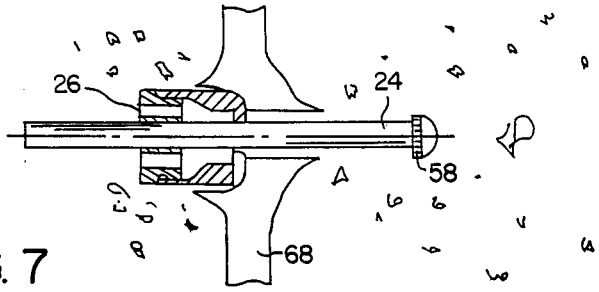

FIGS. 3 through 7 are schematical representations of the projectile 20 of FIG. 1 at several sequential stages during penetration of a pair of successive increasingly thicker plates 66, 68 of a target. In FIG. 3, the impact of the projectile nose 30 with the thinner plate 66 has ignited the incendiary charge 48 in the nose bore 42 causing expansion thereof as the projectile penetrates the plate 66. FIG. 3 depicts bursting and destruction of the casing nose 30 after the projectile 20 has moved beyond the thinner plate 66. Also, the ignited incendiary charge 48 has spread rearward through the apertures 56 in the ring 26 toward the explosive charge 50. In FIG. 6, the explosive charge 50 has detonated and, as a result, the annular ring 26 and the penetrator 24 therewith (as well as a remaining fragment of the nose 30) have been accelerated to a higher velocity toward the thicker plate 68 of the target. It should be pointed out here that the apertures 56 are large enough in diameter to allow spreading of the ignition therethrough, but small enough to prevent any significant venting of the energy of the detonated explosive surface area to absorb the explosive energy and provide the necessary thrust for accelerating the penetrator 24 away from the rest of the projectile 20. Also, the rim 52 on the annular ring 26 providing the connection with the body groove 46 will shear and the ring will then release from the casing 22 upon detonation of the explosive charge 50. In FIG. 7, the penetrator 24 has successfully penetrated the thicker target plate 68 and the annular ring 26 is stripped from the penetrator as it passes through the plate. The penetrator 24 should still have sufficient residual velocity to destroy the portion of the target behind the thick plate 68.

It will be noted that the trailing end 34 of the main body 28 preferably contains a recess 72 (see FIG. 5) which receives and axially and laterally supports the rear end of the penetrator 24 (and 24', 24''). Additionally, the penetrator can also be constructed of the same heavy material, for example tungsten, depleted uranium or steel.

Figure 8:
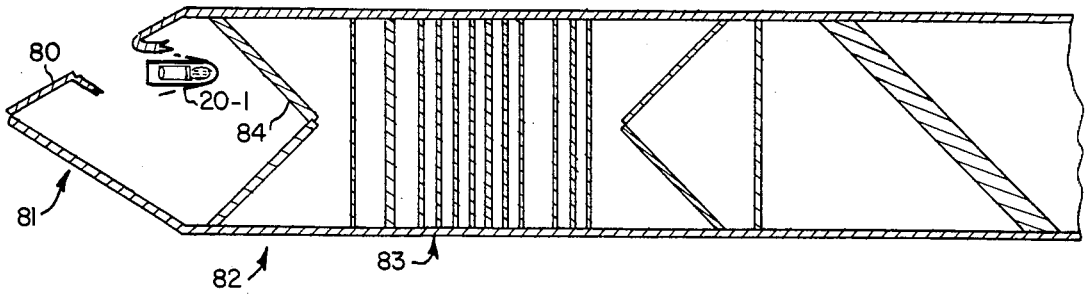
FIG. 8 shows a cross sectional view of the front portion of a missile while being struck by the first round numbered 20-1.
Figure 9:
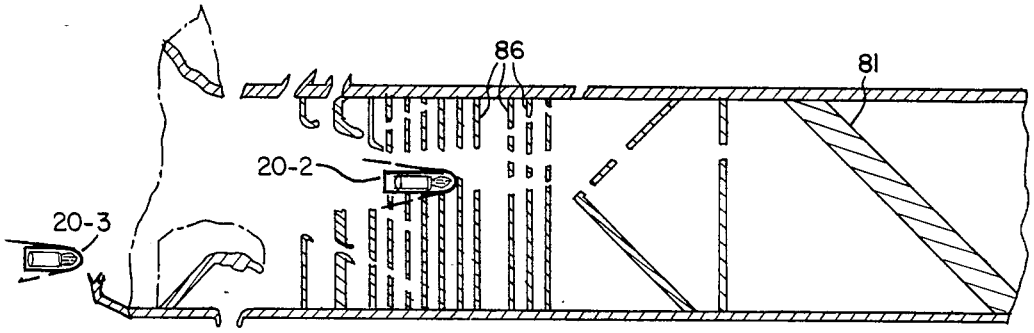
FIG. 9 shows the same missile after round 20-1 detonated inside, note the absence of the front section allowing round 20-2 to travel deep into the missile before hitting a plate and functioning. Round 20-3 can be seen following round 20-2 which upon detonation will further reduce the amount of target to penetrate for round 20-3, etc.

FIGS. 8–9 show a preferred usage of the projectile of the invention, destroying cruise missiles. In FIG. 8, a first round 20-1 has penetrated the surface skin layer 80 of the nosecone 81 a missile 82 having a protective plate array 83 and is just contacting the first protective plate 84 of array 83. Round 20-1 should then detonate to blast apart nosecone 81 by over pressure, impact and the heavy fragments. FIG. 9 shows the result of multiple target hits. A second round 20-2 is passing through a series of secondary plates 86 of array 83 and will soon detonate. Round 20-3 is about to enter missile 82. Round 20-2 should have destroyed secondary plates 86 by that time and round 20-3 should impact on main plate 88 and its penetrator should pierce plate 88 to ignite the explosive missile warhead (not shown) behind plate 88, thus destroying the missile 82. While a missile target is shown, similar multiple plate arrays are suitable targets whether or not in a missile.

Figure 10:
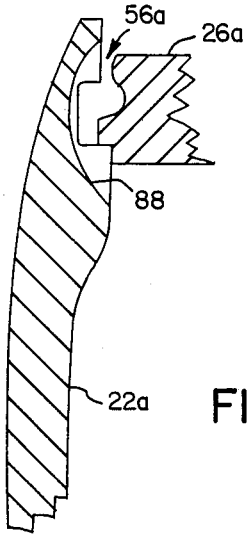
FIG. 10 shows an alternative passageway through the projectile body around the drive ring.

FIG. 10 shows an alternative passageway **56*a* around rather than through the drive ring 26 which could be used instead of apertures 56. Passageway 56*a* is defined by the outside of ring 52*a*, (the ring 52*a* could be solid in this case) and a recess or slot 88 in the inside surface of casing 22*a***.

It is thought that the improved projectile and many of its attendant advantages will be understood from the foregoing description and it will be apparent that various changes may be made in the form, construction and arrangement of the parts thereof without department from the spirit and scope of the invention or sacrificing all of its material advantages, the form hereinbefore described being merely a preferred or exemplary embodiment thereof.

I claim:

1. A projectile with enhanced power for penetrating a target, comprising:

(a) an elongated casing having a main body with a hollow cavity defined therein and a nose with a hollow bore defined therein, said nose being interfitted with said main body and merged at its bore with said cavity of said main body;

(b) an elongated rod-like penetrator extending longitudinally within said casing and through said cavity in said main body thereof and into said bore of said nose thereof;

(c) a first destructive charge disposed in said nose bore;

(d) a second destructive charge disposed in said main body cavity; and (e) means disposed within said casing so as to generally separate said nose bore and said main body cavity and retain said first charge in said nose bore, said means receiving and aligning said penetrator for forward penetrating travel upon impact of said nose with the target and also containing at least one passageway which provides communication of said nose bore with said main body cavity for allowing travel of ignition of said first charge from said nose bore to said second charge in said main body cavity and detonation of said second charge in said main body cavity after impact of said nose with the target, said means receiving and aligning said penetrator also being coupled to said penetrator and disposed with respect to said second charge such that said means absorbs the energy of said second charge and provides the necessary thrust for acceleration of said penetrator to a higher velocity upon detonation of said second charge.

2. The projectile as recited in claim 1, wherein said means receiving and aligning said penetrator is an annular support ring disposed within said casing at the location where said nose is interfitted with said main body, said ring being anchored to at least one of said main body and nose of said casing.

3. The projectile as recited in claim 2, wherein said ring has a central opening through which said penetrator is received and aligned for forward penetrating travel upon impact of said nose with the target.

4. The projectile as recited in claim 1, wherein said coupling between said penetrator and said receiving and aligning means is in the form of means defined on said penetrator which overlies said receiving and aligning means and is disposed within said nose bore.

5. The projectile as recited in claim 4, wherein said coupling, means between said penetrator and said receiving and aligning means is in the form of a head defined on said penetrator which overlies said receiving and aligning means and is disposed within said nose bore.

6. The projectile as recited in claim 4, wherein said coupling means between said penetrator and said receiving and aligning means is in the form of a shoulder defined on said penetrator which overlies said receiving and aligning means and is disposed within said nose bore.

7. The projectile of claim 1, wherein the second destructive charge comprises a gas producing charge and an explosive charge.

8. The projectile as recited in claim 1, wherein said first charge is an incendiary charge and said second charge includes an incendiary charge followed by an explosive charge.

9. A projectile with enhanced power for penetrating a target, comprising:

(a) an elongated casing having a main body and a nose, said main body having opposite leading and trailing ends and a hollow cavity defined therein, said cavity extending between said opposite leading and trailing ends and being closed at said trailing end and open at said leading end of said body, said nose having opposite front and rear ends and a hollow bore defined therein, said bore extending between said front and rear ends and being closed at said front end and open at said rear end of said nose, said nose being interfitted at its rear end with said leading end of said main body and being merged at its bore with said cavity of said main body so as to interconnect and close said rear nose and leading body ends;

(b) an elongated rod-like penetrator extending longitudinally within said casing and through said cavity in said main body thereof and into said bore of said nose thereof;

(c) an incendiary charge disposed in said nose bore;

(d) an explosive charge disposed in said main body cavity about said penetrator; and (e) an annular support ring disposed within said casing at generally the location where said rear nose end is interfitted with said leading main body end and said nose bore is merged with said main body cavity so as to generally separate said nose bore and said main body cavity and retain said incendiary charge in said nose bore, said ring being anchored to at least one of said main body and nose of said casing and having a central opening through which said penetrator is received and aligned for forward penetrating travel upon impact of said nose with the target, said ring also containing a plurality of axially-extending passageways which provide communication of said nose bore with said main body cavity through said ring for allowing travel of ignition of said incendiary charge in said nose bore through said ring to said explosive charge in said main body cavity and detonation of said explosive charge about said penetrator in said main body cavity after impact of said nose with the target, said ring being coupled to said penetrator and disposed with respect to said explosive charge such that said ring absorbs the energy of said explosive charge and provides the necessary thrust for acceleration of said penetrator to a higher velocity upon detonation of said explosive charge.

10. The projectile as recited in claim 9, wherein said coupling between said penetrator and said ring is in the form of means defined on said penetrator which overlies said ring and is disposed within said nose bore.

11. The projectile as recited in claim 10, wherein said coupling means between said penetrator and said ring is in the form of a head defined on said penetrator which overlies said ring on a side thereof facing said nose bore.

12. The projectile as recited in claim 10, wherein said coupling means between said penetrator and said ring is in the form of a shoulder defined on said penetrator which overlies said ring on a side thereof facing said nose bore.

13. The projectile of claim 9, wherein said main body cavity also includes a gas producing charge disposed about said penetrator.

14. A projectile with enhanced power for penetrating a target, comprising:

(a) an elongated casing having a main body with a hollow cavity defined therein and a nose with a hollow bore defined therein, said nose being interfitted with said main body and merged at its bore with said cavity of said main body;

(b) an elongated rod-like penetrator extending longitudinally within said casing and through said cavity in said main body thereof and into said bore of said nose thereof;

(c) a first destructive charge disposed in said nose bore;

(d) a second destructive charge disposed in said main body cavity; and (e) means disposed within said casing so as to generally separate said nose bore and said main body cavity and retain said first charge in said nose bore, said means receiving and aligning said penetrator for forward penetrating travel upon impact of said nose with the target and also containing at least one passageway which provides communication of said nose bore with said main body cavity for allowing travel of ignition of said first charge from said nose bore to said second charge in said main body cavity and detonation of said second charge in said main body cavity after impact of said nose with the target, said means receiving and aligning said penetrator also being coupled to said penetrator and disposed with respect to said second charge such that said means absorbs the energy of said second charge and provides the necessary thrust for acceleration of said penetrator to a higher velocity upon detonation of said second charge, said means receiving and aligning said penetrator being an annular support ring disposed within said casing at the location where said nose is interfitted with said main body, said ring being anchored to at least one of said main body and nose of said casing, said ring having a central opening through which said penetrator is received and aligned for said forward penetrating travel upon impact of said nose with the target, said at least one passageway being disposed through said ring outwardly from said central opening thereof, said coupling between said penetrator and said ring being in the form of means defined on said penetrator which overlies said ring and is disposed within said nose bore.

15. The projectile as recited in claim 14, wherein said coupling between said penetrator and said ring is in the form of a head defined on said penetrator which overlies said ring and is disposed within said nose bore.

16. The projectile as recited in claim 14, wherein said coupling between said penetrator and said ring is in the form of a shoulder defined on said penetrator which overlies said ring and is disposed within said nose bore.

* * * * *

UNITED STATES PATENT AND TRADEMARK OFFICE
Certificate

Patent No. 4,648,324 Patented: March 10, 1987

On petition requesting issuance of a certificate for correction of inventorship pursuant to 35 U.S.C. 256, it has been found that the above-identified patent, through error and without any deceptive intent, improperly sets forth the inventorship. Accordingly, it is hereby certified that the correct inventorship of this patent is:
Brian K. McDermott and Michael L. Martin.

Signed and Sealed this Twenty-eighth Day of August 1990.

CHARLES T. JORDON

*Supervisory Patent Examiner*
*Art Unit 221*